US007516815B2

(12) United States Patent
Rose et al.

(10) Patent No.: US 7,516,815 B2
(45) Date of Patent: Apr. 14, 2009

(54) ARRANGEMENT FOR THE GENERATION OF SONIC FIELDS OF A SPECIFIC MODAL COMPOSITION

(75) Inventors: Marco Rose, Freiberg (DE); Fredi Holste, Berlin (DE); Frank Arnold, Berlin (DE); Alastair D Moore, Derby (GB)

(73) Assignee: Roll-Royce Deutschland Ltd & Co KG, Blankenfelde-Mahlow (DE)

( * ) Notice: Subject to any disclaimer, the term of this patent is extended or adjusted under 35 U.S.C. 154(b) by 272 days.

(21) Appl. No.: 11/068,980

(22) Filed: Mar. 2, 2005

(65) Prior Publication Data

US 2005/0194206 A1 Sep. 8, 2005

(30) Foreign Application Priority Data

Mar. 3, 2004 (EP) ..... 04090083

(51) Int. Cl.
*E04F 17/04* (2006.01)

(52) U.S. Cl. ..... 181/224; 181/214; 181/217; 181/218; 181/220; 415/119; 244/1 N

(58) Field of Classification Search ..... 415/119; 181/224, 214, 217, 218, 220, 292; 244/1 N
See application file for complete search history.

(56) References Cited

U.S. PATENT DOCUMENTS 2,514,129 A 7/1950 Horsley et al.
2,704,504 A * 3/1955 Wilkening ..... 454/195
2,708,006 A * 5/1955 Backman ..... 181/225
2,987,033 A 6/1961 Coceano
3,292,727 A 12/1966 Bschorr
3,344,882 A * 10/1967 Bellion et al. ..... 181/221
3,378,100 A * 4/1968 Welty ..... 181/224
3,533,486 A * 10/1970 Paulson ..... 181/214
3,575,259 A * 4/1971 Wilkinson ..... 181/214

(Continued)

FOREIGN PATENT DOCUMENTS

DE 101 03 942 5/2002

(Continued)

OTHER PUBLICATIONS

European Search Report dated Sep. 6, 2004.

*Primary Examiner*—Walter Benson
*Assistant Examiner*—Jeremy Luks
(74) *Attorney, Agent, or Firm*—Timothy J. Klima

(57) ABSTRACT

A device for simulating sound produced by certain equipment, for example a rotor-stator arrangement of a turbomachine, or for generation of opposing sound fields for active sound control, including active sound reduction and active sound amplification, comprises flow obstacles (2) provided in a flow duct (1) flown by a fluid at which vortices (5, 6) are shed at a certain frequency depending on the shape and size of the flow obstacles and the velocity of flow. The quantity and spatial arrangement of the flow obstacles is selected such that a periodically spatially and temporally changing pressure field for the excitation of a sound field (8) of a certain modal content is produced by the entirety of the vortices shed. This sound field reacts synchronizingly on the vortex shedding. The resonant circuit so formed, whose vortex shedding frequency is in the range of the resonant frequency of the sound field to be excited, is the sound source.

19 Claims, 6 Drawing Sheets

U.S. PATENT DOCUMENTS 3,612,446 A * 10/1971 Lebert ..... 244/35 R
4,241,805 A * 12/1980 Chance, Jr. ..... 181/232
4,298,089 A * 11/1981 Birch et al. ..... 181/213
4,300,656 A * 11/1981 Burcham ..... 181/214
4,327,816 A * 5/1982 Bennett ..... 181/292
4,336,863 A * 6/1982 Satomi ..... 181/224
4,346,781 A * 8/1982 Ingard et al. ..... 181/206
4,439,104 A * 3/1984 Edmonds ..... 415/161
4,464,108 A * 8/1984 Korenyi ..... 431/265
4,555,433 A * 11/1985 Jablonka et al. ..... 428/166
4,718,393 A * 1/1988 Bakish ..... 123/593
4,755,416 A * 7/1988 Schneider et al. ..... 428/167
4,909,346 A * 3/1990 Torkelson ..... 181/213
5,332,872 A * 7/1994 Ewanek ..... 181/224
5,590,849 A 1/1997 Pla
5,702,230 A 12/1997 Kraft et al.
5,904,318 A * 5/1999 Towfiq ..... 244/1 N
5,947,081 A * 9/1999 Kim ..... 123/306
5,970,963 A * 10/1999 Nakase et al. ..... 123/590
6,092,621 A * 7/2000 Kinzie ..... 181/218
6,145,616 A * 11/2000 Ewanek ..... 181/224
6,309,176 B1 * 10/2001 Periyathamby et al. ..... 415/119
6,471,157 B1 * 10/2002 Streett et al. ..... 244/1 N
6,901,907 B2 * 6/2005 Wijaya ..... 123/306
2002/0036115 A1 * 3/2002 Wilson ..... 181/292
2005/0045419 A1 * 3/2005 Choi et al. ..... 181/270
2005/0076668 A1 * 4/2005 Choi ..... 62/404
2005/0115763 A1 * 6/2005 Maybeck ..... 181/217

FOREIGN PATENT DOCUMENTS

JP 05077794 A * 3/1993

* cited by examiner

ARRANGEMENT FOR THE GENERATION OF SONIC FIELDS OF A SPECIFIC MODAL COMPOSITION

This application claims priority to European Patent Application EP04090083.9 filed Mar. 3, 2004, the entirety of which is incorporated by reference herein.

BACKGROUND OF THE INVENTION

This invention relates to an arrangement for the generation of sound fields of a specific modal composition as simulated sound source for acoustic investigations, in particular for the simulation of the sound produced by rotor-stator arrangements of turbomachines, for active sound amplification, or as an opposing sound field for active sound reduction.

In many technical sectors, the application and operation of certain equipment, for example aircraft propulsion units, automobile drive units, compressors, gas turbines, venting systems, fans and the like, involves an undesired, aero-acoustic sound level. With such equipment, for example rotor-stator systems of compressors and gas turbines, the performance of investigations into the causes of generation and propagation of air-borne noise or into measures for noise attenuation using a real-life test arrangement involves considerable technical investment. In the case of turbomachines, such investigations can be performed with rotor-stator arrangements which, due to the necessary drive units, the moving components, the high weight and the required control mechanisms, are complicated and expensive. In addition, the generation of a simulated sound field for test purposes or as opposing sound field for active sound reduction, as described, for example, in U.S. Specifications U.S. Pat. No. 5,702,230 or U.S. Pat. No. 5,590,849, also requires considerable apparatus, control and energetic investment for the provision and operation of active elements, such as loudspeakers or piezo-electric sound sources. Additional problems arise from the provision of powerful actuators, their high weight, power demand and operation at elevated temperatures, pressures and velocities of flow.

BRIEF SUMMARY OF THE INVENTION

The present invention, in a broad aspect, provides an arrangement for the generation of sound fields of specific modal content, hereinafter referred to as mode generator, for application as simulated sound source for scientific-technical investigations, for active sound amplification or as an opposing sound field for active sound reduction which is simply designed and inexpensively producible and operable.

It is a particular object of the present invention to provide solution to the above problems by equipment designed in accordance with the features of described herein. Further objects and advantages of the present invention will become apparent from the description below.

In other words, the idea underlying the present invention is the provision of a mode generator comprising a flow duct which is passed by a fluid, in particular a gas, and of flow obstacles arranged within this flow duct. The flow obstacles are designed such that they shed vortices from the flow medium. The shape and size of the flow obstacles and the velocity of flow within the flow duct are selected such that a certain vortex shedding frequency is not undershot. The quantity and spatial arrangement of the flow obstacles is such that a pressure field is produced by the entirety of the vortices shed which periodically changes in time and space. This pressure field excites a sound field of specific modal composition which synchronizingly reacts on the vortex shedding. The feedback-caused resonant circuit so produced, whose vortex shedding frequency is in the range of the resonant frequency of the sound field, is a sound source. Accordingly, a sound wave for specific acoustic investigations can be simulated in the simplest manner, such as for example, a sound wave for the stator-rotor arrangement in the case of turbo-engine investigations. Similarly, this simple and cost-effective arrangement enables active sound control, including active sound amplification, and generation of opposing sound fields for active sound reduction. The present arrangement allows the apparatus, weight and cost investment to be reduced significantly.

BRIEF DESCRIPTION OF THE DRAWINGS

The present invention is more fully described in the light of the accompanying drawings showing preferred embodiments. In the drawings.

DETAILED DESCRIPTION OF THE INVENTION

Figure 1:
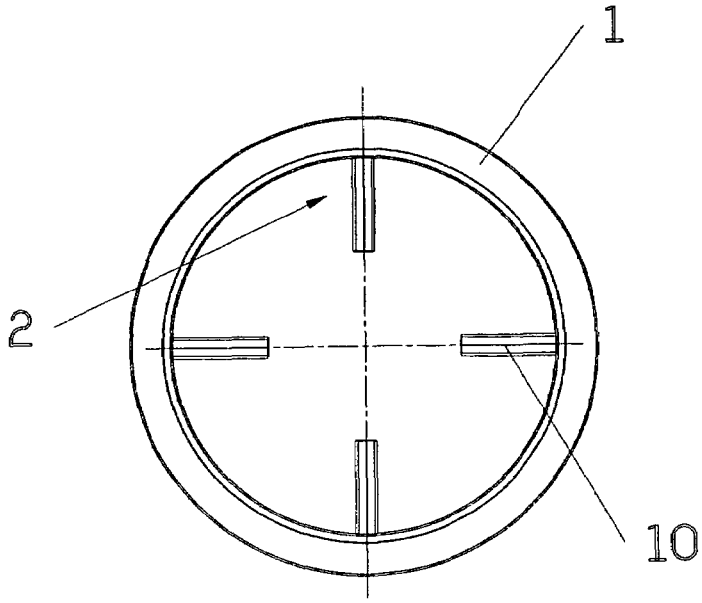
FIG. 1 is a side view of an arrangement according to the present invention for the generation of modal sound fields (aero-acoustic mode generator)
Figure 2:
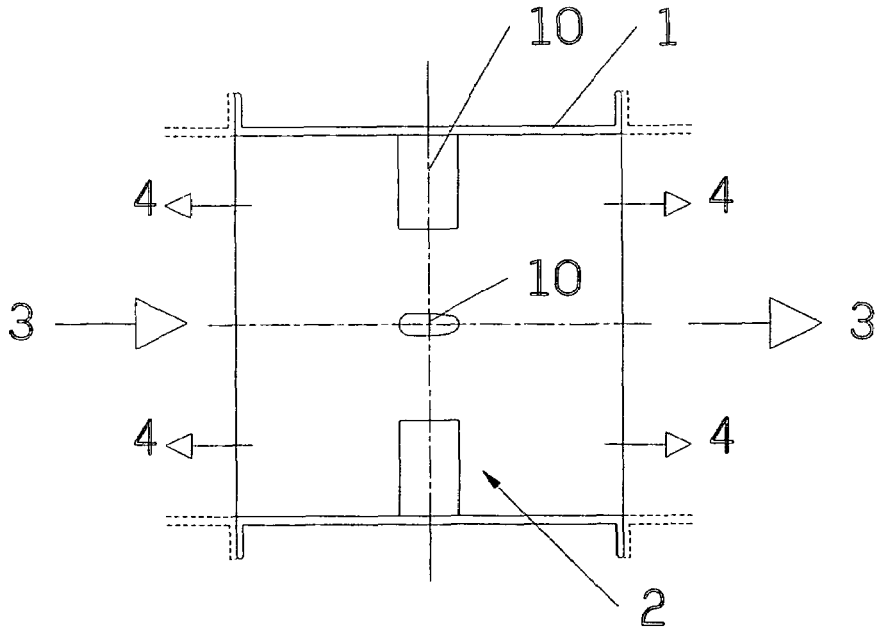
FIG. 2 is a longitudinal section of the arrangement according to FIG. 1.
Figure 3:
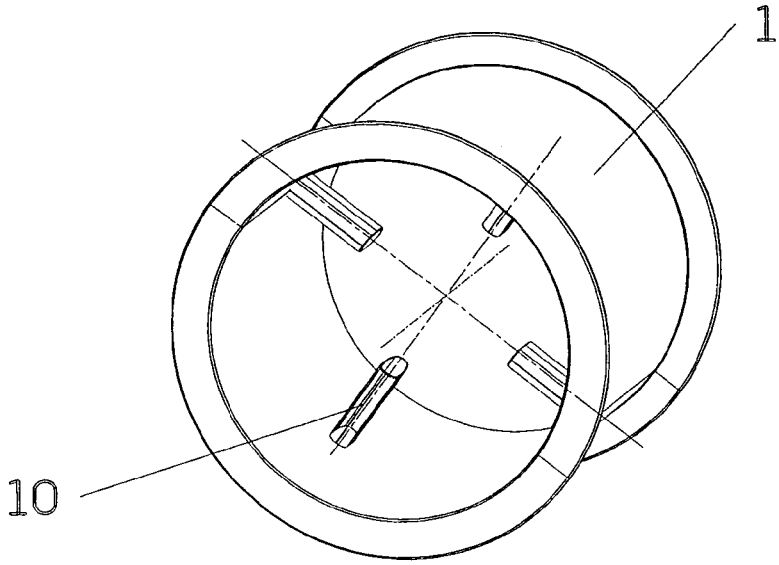
FIG. 3 is a perspective view of the arrangement according to FIG. 1.
Figure 4:
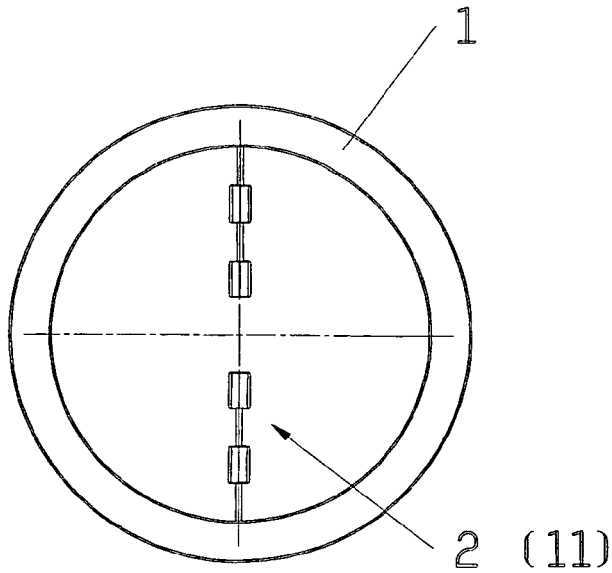
FIG. 4 is a side view of another embodiment of an arrangement for the generation of modal sound fields.
Figure 5:
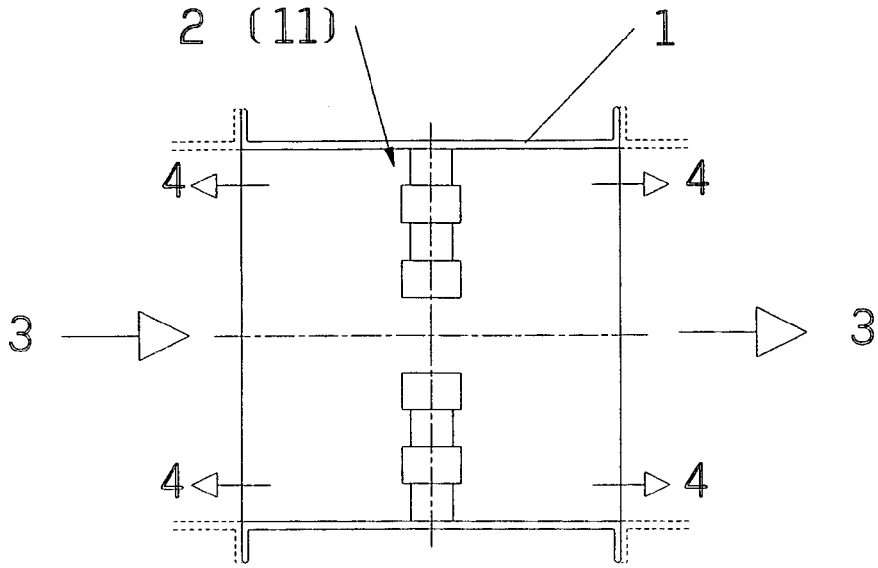
FIG. 5 is a longitudinal section of the arrangement according to FIG. 4.
Figure 6:
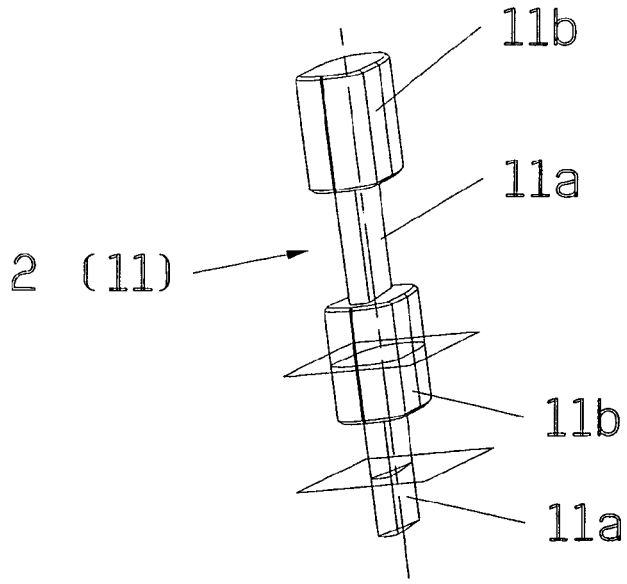
FIG. 6 is a perspective view of a flow obstacle in accordance with the embodiment of FIG. 4.
Figure 7:
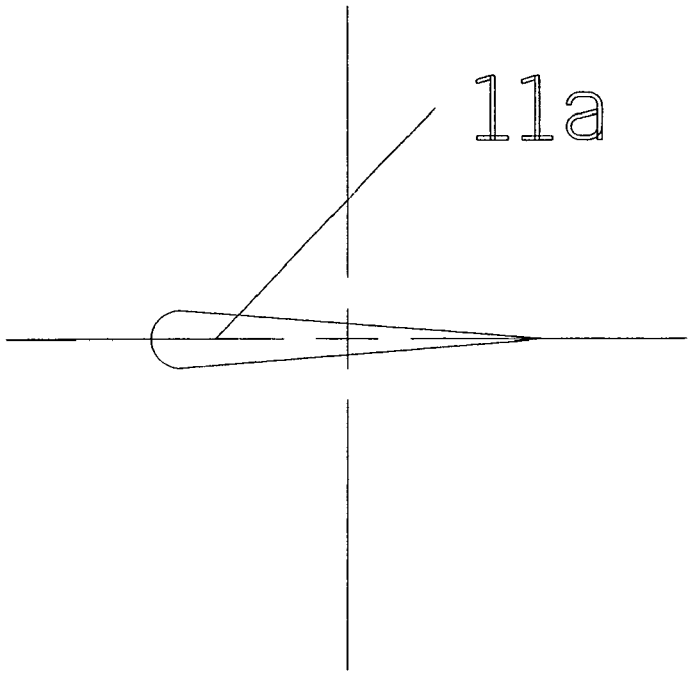
FIG. 7 is a sectional view of the stay of the flow obstacle according to FIG. 6.
Figure 8:
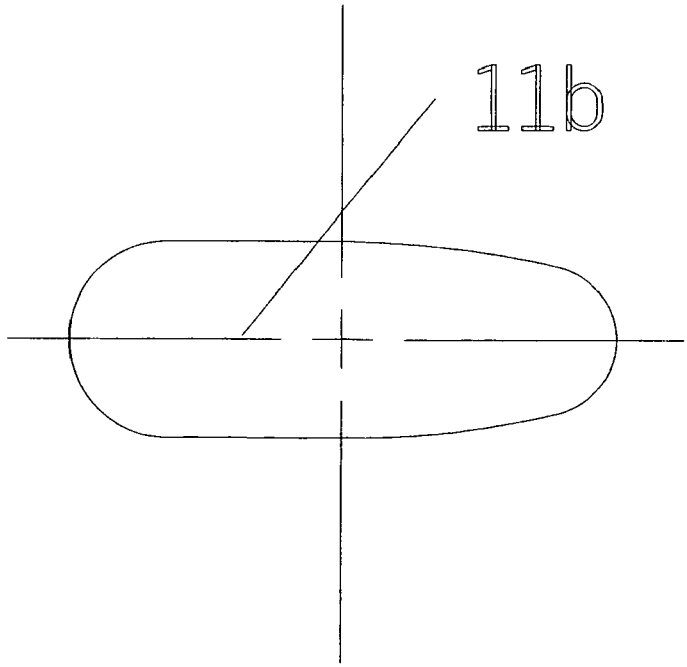
FIG. 8 is a sectional view of the vortex shedding flow obstacle according to FIG. 6.

As shown in the drawings, flow obstacles 2 are arranged at regular intervals on the inner circumference of a flow duct 1 which, according to FIGS. 1 to 3, have the form of rectangular, equally long projections 10 with rounded edges. These projections 10 are located in only one cross-sectional plane and stick out vertically from the flow duct inner wall. Accordingly, for the generation of different modal sound fields, the flow obstacles 2 may also have other cross-sectional shapes, extend farther (or lesser) into the flow duct interior, or, as shown in FIGS. 4 to 8, be arranged on stays in the flow duct 1 or, as shown in *Fig*. 10, be provided as cavities in the flow duct wall. The cross-sectional shape of the flow obstacles 2, in particular, is essential for the generation of the sound field in the flow duct 1. Furthermore, the flow obstacles 2 in one and the same flow duct 1 may have different form. Finally, the arrangement and quantity of the flow obstacles 2 is variable. This means that the flow obstacles 2, individually or in a larger number, may also be arranged in two or more cross-sectional planes of the flow duct I, and actually also be offset to each other (none of these arrangements being shown). The positioning of the obstacles may also be adjusted as desired to provide the desired sound field. The flow duct can be constructed to allow quick and easy variation of these factors to alter the sound field, The flow duct 1 is passed by a fluid, here a gas, in the direction of arrow 3. See FIGS. 2, 5 and 9. In a case of a simulation of the sound field of a rotor-stator arrangement for a gas turbine, compressor or similar machine, the fluid can be a hot gas, a cold gas or a liquid. Sound propagates in the flow direction 3, as well as opposite to the flow direction 3, as indicated by the arrows 4. In the variant shown in FIGS. 4 to 8, projections 11 with two vortex shedding portions 11*b* each are provided as flow obstacles 2 which are formed onto a stay 11*a* and are spaced from each other and located remote of the duct inner wall. The stay 11*a* is profiled such that, as shown in FIG. 7, essentially no vortices will be shed by it.

Figure 9:
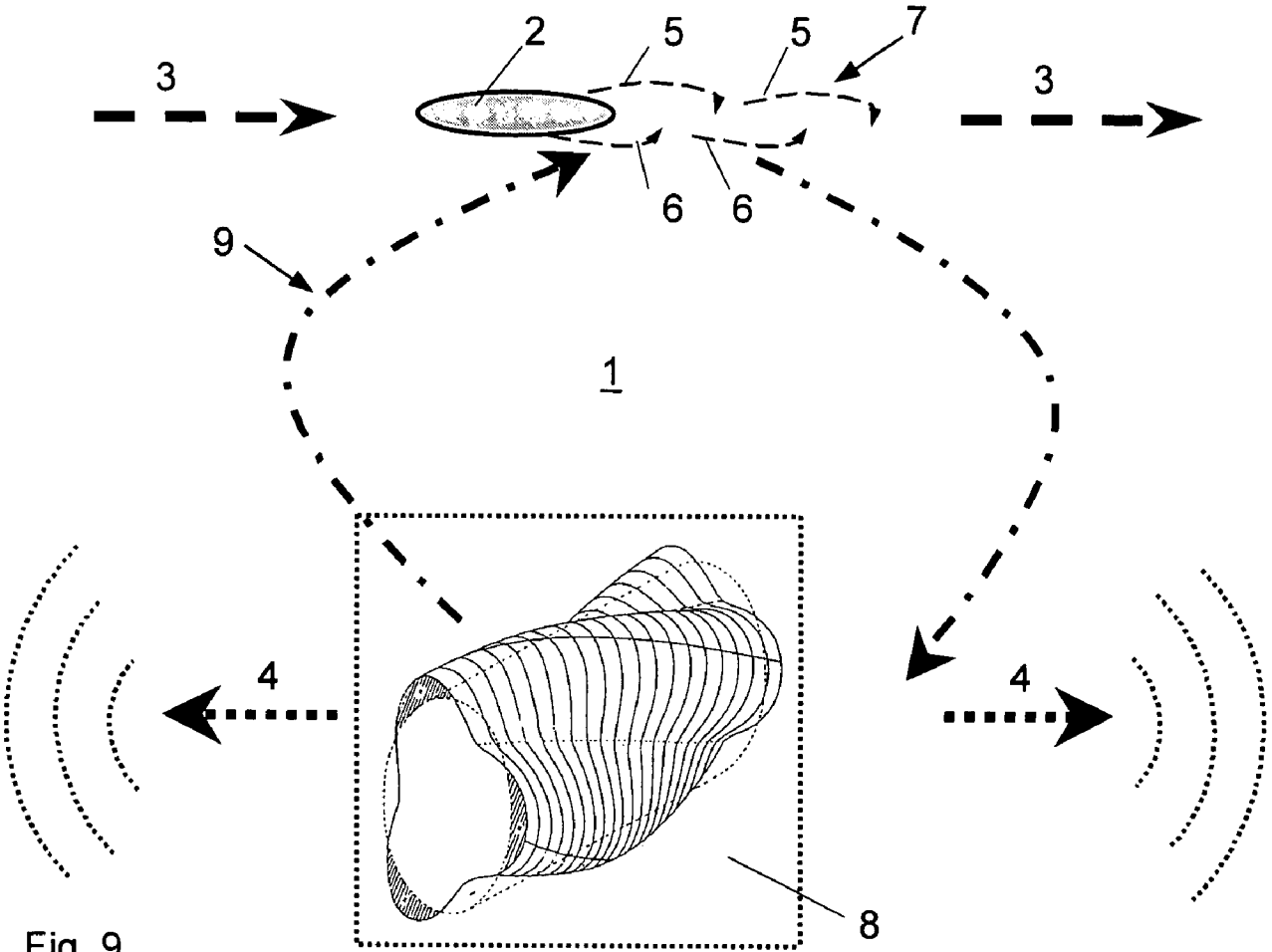
FIG. 9 is a representation of the operating principle of the arrangement for the generation of modal sound fields.
Figure 10:
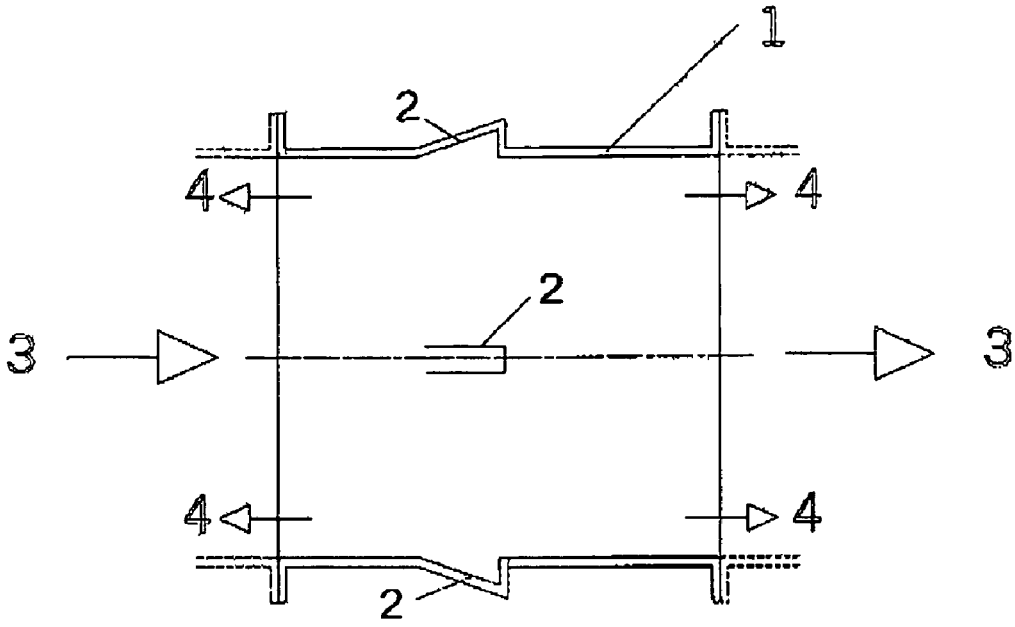
FIG. 10 is a sectional view of the flow duct showing the flow obstacles as cavities in the flow duct wall.

The operation of the above described sound field generator (aero-acoustic mode generator) for conversion of a portion of the flow energy of the fluid into acoustic energy of a sound field propagating in the direction of flow and opposite to the direction flow is hereinafter described in light of FIG. 9.

On account of the flow, vortices 5 and 6 are periodically shed at the flow obstacle 2 which, downstream of the flow obstacle 2, form a vortex path 7. The shedding frequency of the vortices 5, 6 depends on the flow velocity and the shape and size of the respective flow obstacle 2. The alternating pressures produced by the periodic vortex shedding create sounds which will propagate in the flow duct 1 at and beyond a certain frequency (cut-on frequency, resonant frequency). This frequency depends on the geometry of the duct (cross-sectional shape, dimensions), the velocity of flow and the gas temperature. The sounds produced by the periodic shedding of vortices form an acoustic pressure field 8 in the flow duct 1, i.e. a modal sound field or at least an acoustic mode with circumferentially and/or radially variable amplitude which reacts synchronously on the flow obstacle 2 and on the periodic shedding of vortices from the flow obstacle 2 (feedback loop according to arrow 9). A closed resonant loop is created between vortex shedding and acoustic mode 8 as well as between acoustic mode 8 and vortex shedding, i.e. the acoustic mode imparts its frequency and phase on the vortex shedding, with a high sound pressure level being generated by the synchronous feedback of the modes on the shedding of vortices which is capable of simulating certain noise situations in technical equipment, for example in a rotor-stator arrangement, or which can be used—phase-displaced—for active sound control, including reduction and amplification of an existing sound pressure level. The energy necessary for sound generation is extracted from the energy of the flow medium, but this extraction of energy is negligible and irrelevant for the operation of the technical equipment under investigation, for example a rotor-stator arrangement of a turbomachine.

To explain the operation in slightly different words, the flow generates vortices downstream of the flow duct 1. The vortices have a pressure field that is unsteady. This creates an acoustic mode inside the flow duct 1 which has a spatial wavelength. The mode synchronizes with the vortices and triggers separation of the vortices at the trailing edges of the flow obstacles 2, thereby creating a feedback loop. A portion of this energy can then be used to actively reduce sound of another source.

LIST OF REFERENCE NUMERALS

1 flow duct
2 flow obstacle
3 direction of flow, flow energy
4 sound propagation direction, acoustic energy flow
5 shed vortices
6 shed vortices
7 vortex path, aerodynamic sound source
8 acoustic mode, modal sound field, pressure field
9 feedback loop, feedback between 8 and 2
10 projections with constant section
11 projections with several vortex shedding portions
11*a* stay
11*b* vortex shedding portion

What is claimed is:

1. A method for generating sound fields of a specific modal composition; comprising:

providing a fluid flow through a flow duct;

providing at least one flow obstacle in the flow duct;

adjusting a shape and size of the at least one flow obstacle, and a velocity of the fluid flow, to create and periodically shed vortices at a certain shedding frequency, selecting a quantity and spatial arrangement of the at least one flow obstacle such that an entirety of the shed vortices produces a periodically spatially and temporally changing pressure field for the excitation of a sound field of a certain modal composition which reacts synchronizingly on the vortex shedding, thereby creating a resultant resonant circuit, whose vortex shedding frequency is in a range of a resonant frequency of the sound field to be excited.

2. A method in accordance with claim 1, and including providing several flow obstacles positioned at intervals in at least one cross-sectional plane of the flow duct.

3. A method in accordance with claim 2, and including projecting the flow obstacles out from an inner wall of the flow duct, and profiling them such that periodic shedding of vortices create a vortex path, as well as the respective modal sound field.

4. A method in accordance with claim 3, and including providing the projections with a stay positioned in the fluid flow and supporting at least one vortex shedding portion spaced from the inner wall of the flow duct in the fluid flow, and profiling the stay such that it produces at most, only negligible vortex shedding.

5. A method in accordance with claim 2, and including providing the flow obstacles as cavities formed into an inner wall of the flow duct.

6. A method in accordance with claim 1, wherein the fluid is one of a cold gas and a hot gas.

7. A method in accordance with claim 1, and including using vibration excitation to control a phase relation of vortex shedding at the flow obstacles.

8. A method in accordance with claim 1, and including providing several flow obstacles that are adjustable in several axes.

9. A method in accordance with claim 2, including positioning the several flow obstacles at regular intervals.

10. A method in accordance with claim 2, including positioning the several flow obstacles at irregular intervals.

11. A method in accordance with claim 2, including positioning the several flow obstacles in multiple circumferential planes.

12. A method in accordance with claim 2, including positioning the several flow obstacles in multiple planes in a direction of fluid flow.

13. A method in accordance with claim 3, and including providing the projections with a stay positioned in the fluid flow and supporting a plurality of vortex shedding portions spaced from each other in the fluid flow, and profiling the stay such that it produces at most, only negligible vortex shedding.

14. A method in accordance with claim 4, and including providing that each stay supports a plurality of vortex shedding portions spaced from each other in the fluid flow.

15. A method in accordance with claim 4, including positioning the several flow obstacles at regular intervals.

16. A method in accordance with claim 4, including positioning the several flow obstacles at irregular intervals.

17. A method in accordance with claim 4, including positioning the several flow obstacles in multiple circumferential planes.

18. A method in accordance with claim 1, and including at least one of simulating a sound produced by rotor-stator arrangements of turbomachines, active sound amplification, and creating an opposing sound field for active sound reduction.

19. A method in accordance with claim 1, wherein the fluid is a liquid.

* * * * *